US005820920A

United States Patent [19]

Ariji et al.

[11] Patent Number: 5,820,920

[45] Date of Patent: Oct. 13, 1998

[54] METHOD OF PRODUCING CATHODE RAY TUBE

[75] Inventors: Saori Ariji, Kanagawa; Nobuyuki Matsushima, Tokyo; Shuichi Saito, Kanagawa, all of Japan

[73] Assignee: Sony Corporation, Tokyo, Japan

[21] Appl. No.: 647,756

[22] Filed: May 15, 1996

[30] Foreign Application Priority Data

May 15, 1995 [JP] Japan ..... 7-116068

[51] Int. Cl.[6] ..... B05D 5/06

[52] U.S. Cl. ..... 427/64; 427/64; 427/230; 427/236; 427/264; 427/287; 427/389.7; 427/314; 427/336

[58] Field of Search ..... 427/64, 68, 264, 427/230, 236, 389.7, 287, 314, 336

[56] References Cited

U.S. PATENT DOCUMENTS

| | | | |
|---|---|---|---|
| 2,937,107 | 5/1960 | Phillips | 427/64 |
| 2,987,415 | 6/1961 | Taggett | 427/64 |
| 3,473,942 | 10/1969 | Magill et al. | 427/68 |

*Primary Examiner*—Janyce Bell
*Attorney, Agent, or Firm*—Hill & Simpson

[57] ABSTRACT

A method of producing a cathode ray tube comprising forming a phosphor layer on the inner surface of a panel of a glass bulb, forming an lacquer intermediate film on the phosphor layer, removing the lacquer intermediate film formed on the inner surface of the funnel of the glass bulb by a liquid in a state with the temperature of the glass bulb higher than the temperature of the liquid.

8 Claims, 3 Drawing Sheets

FLOW CHART OF PRECIPITATION OF PHOSPHOR LAYER ON CRT

FLOW CHART OF PRECIPITATION OF PHOSPHOR LAYER ON CRT

METHOD OF PRODUCING CATHODE RAY TUBE

BACKGROUND OF THE INVENTION

1. Field of the Invention

The present invention relates to a method of producing a cathode ray tube, more particularly relates to an improvement of the trimming step of a lacquer intermediate film formed on the inner surface of the cathode ray tube.

2. Description of the Related Art

Cathode ray tubes have glass bulbs comprised of a panel, funnel, and neck. Electrons are emitted from an electron gun to a phosphor layer formed on the inner surface of the panel so as to cause the phosphors to emit light.

Among this type of cathode ray tube, the cathode ray tubes for projection televisions and cathode ray tubes for black and white televisions are for example produced in the following way. First, the inner surface of the glass bulb on which the phosphor layer is to be formed is cleaned by pure water etc., then an aqueous solution of barium acetate or other aqueous solution of an electrolyte is filled in the bulb, then a suspension of phosphors dispersed in an aqueous solution of water glass serving as the adhesive is poured in and allowed to stand for a predetermined time to allow the phosphors to precipitate. After the phosphors precipitate, the glass bulb is slowly tilted so as to form the phosphor layer.

Next, a continuous, good aluminum vapor deposited film is formed by moistening the phosphor layer by pure water etc., covering the majority of the phosphor layer with a film of water, then spraying an organic solvent lacquer comprised mainly of an acrylic resin to form a very thin lacquer intermediate film on the water film. Next, the lacquer intermediate film from the funnel to the neck, where the phosphor layer is not to be formed, is removed by filling pure water. This is because if a lacquer intermediate film is formed at a region where no phosphor layer is to be provided, the aluminum vapor deposited film formed on that region will swell up during the later baking step and cause peeling from the funnel of the cathode ray tube.

Further, demoisturized air etc. is used to dry the phosphor layer, then a predetermined region is coated and dried with a carbon film. Finally, aluminum is vapor deposited to form an aluminum vapor deposited film, then the organic material used at the time of forming the phosphor layer is heated to 400° to 440° C. to cause it to break down for removal. The phosphor layer is formed through these steps.

In the above method of producing a cathode ray tube, however, in the so-called "trimming" step for removing the lacquer intermediate film from the funnel to the neck where the phosphor layer is not to be formed, the temperature of the pure water used for the trimming is higher than the temperature of the glass bulb, so it suffers from the disadvantage that water vapor condenses on the surface of the undried lacquer intermediate film. Because of this, numerous fine pores form in the lacquer intermediate film and the optical transmission of the phosphor layer after formation of the aluminum vapor deposited film becomes non-uniform causing the disadvantage of poor uniformity.

SUMMARY OF THE INVENTION

An object of the present invention is to provide a method of producing a cathode ray tube which prevents the condensation of water vapor caused during the trimming step and thereby enables the formation of a lacquer intermediate film having an excellent surface quality and the improvement of the uniformity of the surface.

According to the present invention, there is provided a method of producing a cathode ray tube including the steps of: forming a phosphor layer on the inner surface of a panel of a glass bulb, forming a lacquer intermediate film on the phosphor layer, and removing the lacquer intermediate film formed on the inner surface of the funnel of the glass bulb by a liquid in a state with the temperature of the glass bulb higher than the temperature of the liquid.

Preferably, between the step of forming the phosphor layer and the step of forming the lacquer intermediate film there is further a step of covering the phosphor layer with a liquid so as to keep the phosphor layer in a moist state and at least before the step of covering the layer with water the temperature of the glass bulb is made higher than the temperature of the liquid.

Preferably, the difference in temperature between the temperature of the glass bulb and the temperature of the liquid is not less than 0° C. and not more than 15° C.

Preferably, the phosphor layer is formed by the precipitation method.

BRIEF DESCRIPTION OF THE DRAWINGS

These and other objects and features of the invention will become more apparent from the following description of the preferred embodiments made with reference to the attached drawings, in which.

DESCRIPTION OF THE PREFERRED EMBODIMENTS

Below, an embodiment of the present invention will be explained with reference to the drawings.

Figure 1:
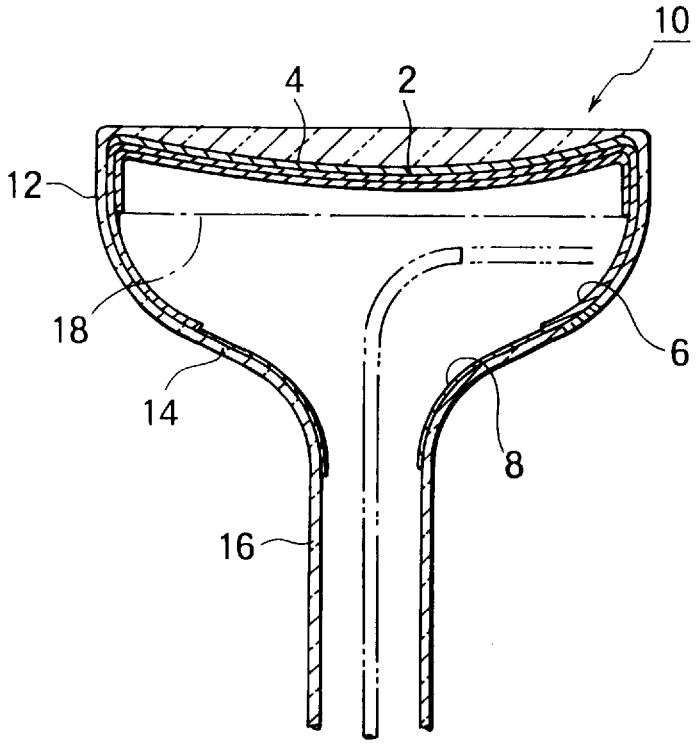
FIG. 1 is a cross-sectional view of a cathode ray tube according to an embodiment of the present invention.

The cathode ray tube used in the present embodiment is one used for a projection television or a black and white television. As shown in FIG. 1, it has a glass bulb 10 comprised of a panel 12, funnel 14, and neck 16 and fires electrons from an electron gun (not shown) to a phosphor layer 2 formed on the inner surface of the panel 12 so as to cause the phosphors included in the phosphor layer 2 to emit light.

On the inner surface of the panel 12 is formed the above-mentioned phosphor layer 2 containing the phosphors. On the surface of the phosphor layer 2 is formed a lacquer intermediate film 4. The lacquer intermediate film 4 is comprised for example of a toluene, ethyl acetate, or other organic solvent lacquer comprising mainly acrylic resin. By interposing a very thin lacquer intermediate film 4 between the phosphor layer 2 and the aluminum vapor deposited film 6, it is possible to obtain a continuous, good aluminum vapor deposited film 6. This lacquer intermediate film 4 is formed up to the connecting portion of the panel 12 and the funnel 14 so as to cover at least the phosphor layer 2.

A conductive carbon film 8 is formed at predetermined regions on the inner surface of the funnel 14. Further, an aluminum vapor deposited film 6 is formed on the inner surface of the panel 12 and the funnel 14 with the objective of preventing ion burning of the phosphors by the electron beam and increasing the light emitting efficiency.

Figure 2:
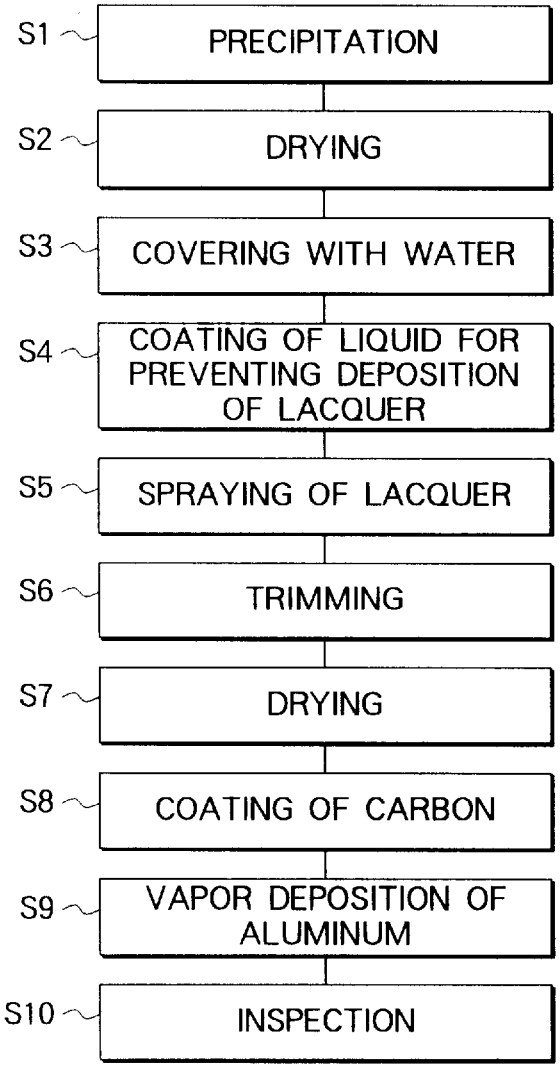
FIG. 2 is a flow chart of the method of producing a cathode ray tube according to an embodiment of the present invention.
Figure 3:
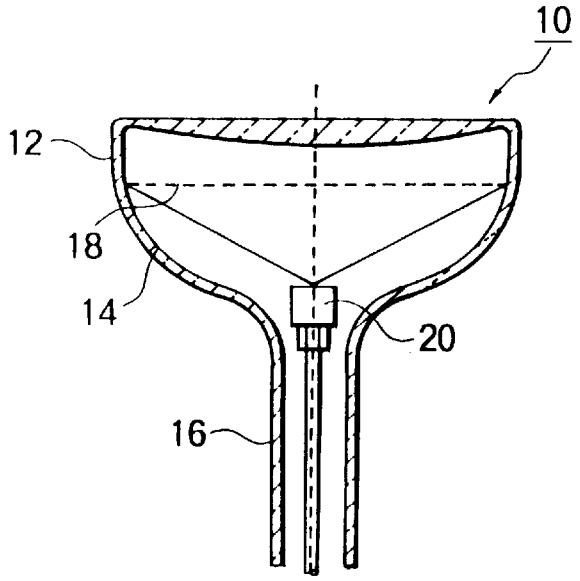
FIG. 3 is a cross-sectional view of a cathode ray tube showing a lacquer spraying step according to an embodiment of the present invention.

Next, the method of production of a cathode ray tube according to this embodiment will be explained with reference to FIG. 2.

First, the inner surface of the glass bulb 10 on which the phosphor layer 2 is to be formed is cleaned using an aqueous solution of hydrogen fluoride, an aqueous solution of nitric acid, and pure water. Next, the panel 12 of the glass bulb 10 is turned downward and a predetermined amount of an aqueous solution of barium acetate or other aqueous solution of an electrolyte is poured in the glass bulb 10. Then, a suspension of predetermined phosphors dispersed in an aqueous solution of water glass serving as the adhesive is poured in and allowed to stand for a predetermined time to allow the phosphors to precipitate (step S1). After the phosphors precipitate, the glass bulb is slowly tilted so as to form the phosphor layer 2. In this case, the phosphor layer 2 is dried by vacuum drying etc (step S2).

After forming the phosphor layer 2, the temperature of the glass bulb 10 is made at least the temperature of the pure water used for the later explained trimming step (S6). In this embodiment, the glass bulb 10 is not directly heated, but the room temperature itself is held to for example 23° C.±1° C. and the pure water used for the trimming is held to 20° C.±1° C. so that the glass bulb 10 becomes at least the temperature of the pure water before covering by water.

Next, a continuous, good aluminum vapor deposited film 6 is formed by moistening the phosphor layer 2 by pure water (covering water) etc. and covering the majority of the phosphor layer 2 with a film of water (step S3), then turning the panel 12 of the glass bulb 10 upward and spraying (step S5) an organic solvent lacquer comprised mainly of an acrylic resin on the inner surface of the panel 12 and the funnel 14 using a nozzle 20 to form a very thin lacquer intermediate film 4 on the water film.

If the lacquer intermediate film 4 is formed on a region where the phosphor layer 2 is not to be formed, the aluminum vapor deposited film 6 vapor deposited on that region will blister by the subsequent baking step and peeling will occur from the funnel 14 of the cathode ray tube, so as shown by the two-dot-dash line in FIG. 1, the lacquer intermediate film 4 from the funnel 14 to the neck 16, where the phosphor layer 2 is not to be formed, is removed by spraying pure water (trimming step S6).

Next, demoisturized air etc. is used to dry the phosphor layer 2 (step S7), then a predetermined region of the inner surface of the glass bulb 10 is coated and dried with electroconductive carbon to form a carbon film 8 (step S8).

Finally, the aluminum is vapor deposited to form an aluminum vapor deposited film 6 (step S9), then the organic material used when forming the phosphor layer 2 is heated to 400° to 440° C. to decompose and remove it.

Next, the results of verification as to what kind of effect the difference between the temperature of the glass bulb 10 before spraying the organic solvent lacquer and the temperature of the pure water used for the trimming has on uniformity.

Figure 4:
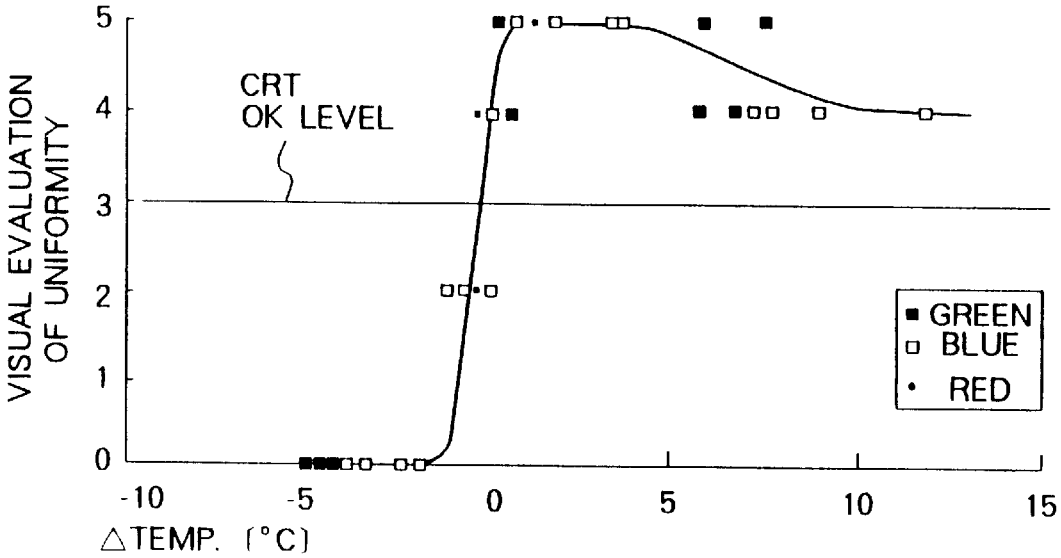
FIG. 4 is a graph of the uniformity with respect to the temperature difference between the glass bulb and pure water for the trimming.

The difference between the temperature of the glass bulb 10 before spraying the organic solvent lacquer and the temperature of the pure water used for trimming was made from −5° C. to +12° C. and the uniformity of the screen was visually evaluated in five stages for each of the green blue, and red phosphors. Note that in the evaluation of uniformity, a score of 3 or more was passing. The results are shown in FIG. 4. From these results, it is clear that for each of the phosphors of green, blue, and red, a good uniformity was achieved when the difference between the temperature of the glass bulb 10 before spraying the organic solvent lacquer and the temperature of the pure water used for trimming was at least 0° C., preferably not less than 0° C. and not more than 15° C.

As explained above, according to the present invention, when removing the lacquer intermediate film formed on the inner surface of the funnel, the temperature of the glass bulb is made higher than the temperature of the liquid, so the water vapor of the liquid does not condense on the glass bulb. As a result, it is possible to form a lacquer intermediate film having a good surface quality free of fine pores and obtain a uniform optical transmission of the phosphor layer after formation of the aluminum vapor deposited film. As a result, the rate of occurrence of defects in the uniformity of the surface falls. Further, the aluminum film becomes uniform and there is no longer unevenness in luminance. In addition, there is no longer uneven deterioration of luminance caused by burning of the phosphors.

In addition, since the temperature of the glass bulb is made higher than the temperature of the lacquer intermediate film at least before the step of covering the layer by water (step S4 in FIG. 2), the lacquer intermediate film is no longer directly heated, deposition of the lacquer intermediate film on the inner surface of the funnel can be prevented, and there is no longer peeling of the aluminum from the funnel of the cathode ray tube.

According to the present invention, as stated earlier, there is provided a method of producing a cathode ray tube including the steps of: forming a phosphor layer on the inner surface of a panel of a glass bulb, forming a lacquer intermediate film on the phosphor layer, and removing the lacquer intermediate film formed on the inner surface of the funnel of the glass bulb by a liquid in a state with the temperature of the glass bulb higher than the temperature of the liquid.

To make the temperature of the glass bulb higher than the temperature of the liquid, the glass bulb may be heated to a temperature above that of the liquid or the liquid may be cooled to below the temperature of the glass bulb.

In the method of producing a cathode ray tube according to the present invention, preferably, between the step of forming the phosphor layer and the step of forming the lacquer intermediate film there is further a step of covering the phosphor layer with a liquid so as to keep the phosphor layer in a moist state and at least before the step of covering the layer with water the temperature of the glass bulb is made higher than the temperature of the liquid. Before the water covering step, there is the step of drying the glass bulb during which the glass bulb drops in temperature. At this time, it is preferable to return the glass bulb to room temperature.

In the method of producing a cathode ray tube according to the present invention, preferably, the difference in temperature between the temperature of the glass bulb and the temperature of the liquid is not less than 0° C. and not more than 15° C. If less than 0° C., water vapor will condense on the lacquer intermediate film, while if over 15° C., the amount of covering water in the water covering step will be reduced and the phosphors will be exposed at the surface of the lacquer intermediate film, whereby it will not be possible to obtain an excellent aluminum vapor deposited film.

Preferably, the method of producing a cathode ray tube according to the present invention is used for a method of production of a cathode ray tube having a phosphor layer formed by the precipitation method.

In summary, in the method of producing a cathode ray tube according to the present invention, first a phosphor layer is formed on the inner surface of the funnel of the glass bulb, a lacquer intermediate film is formed on the phosphor layer, then the lacquer intermediate film formed on the inner surface of the funnel of the glass bulb is removed by a liquid. When removing the lacquer intermediate film formed on the inner surface of the funnel, in the method of producing a cathode ray tube according to the present invention, the temperature of the glass bulb is made higher than the temperature of the liquid, so the water vapor of the liquid will not condense on the glass bulb. As a result, it is possible to form a lacquer intermediate film having a good surface quality with no fine pores and to make the optical transmission of the phosphor layer after the formation of the aluminum vapor deposited film uniform.

Further, in the method of producing a cathode ray tube according to the present invention, when inserting further between the step of forming the phosphor layer and the step of forming the lacquer intermediate film a step of covering the phosphor layer by a liquid so as to moisten the phosphor layer, if the glass bulb is heated to more at least the temperature of the liquid, the lacquer intermediate film would also be heated and the lacquer intermediate film might dry and adhere to the inner surface of the funnel. In this case, however, the temperature of the glass bulb is made higher than the temperature of the liquid before at least the water covering step, so the lacquer intermediate film will not be directly heated and it is possible to prevent deposition of the lacquer intermediate film on the inner surface of the funnel.

Note that the present invention is not limited to the above embodiments and includes modifications within the scope of the claims.

What is claimed is:

1. A method of producing a cathode ray tube comprising the steps of:

forming a phosphor layer on an inner surface of a panel of a glass bulb, forming a lacquer intermediate film at least on the phosphor layer; and removing a portion of the lacquer intermediate film with a liquid in a state such that a temperature of the glass bulb is higher than a temperature of the liquid.

2. A method of producing a cathode ray tube as set forth in claim 1, wherein between the step of forming the phosphor layer and the step of forming the lacquer intermediate film there is a further step of covering the phosphor layer with a liquid and wherein at least before the step of covering the phosphor layer with the liquid the temperature of the glass bulb is made higher than the temperature of the liquid.

3. A method of producing a cathode ray tube as set forth in claim 2, wherein the difference in temperature between the temperature of the glass bulb and the temperature of the liquid is not less than 0° C. and not more than 15° C.

4. A method of producing a cathode ray tube as set forth in claim 3, wherein the phosphor layer is formed by the precipitation method.

5. A method of producing a cathode ray tube as set forth in claim 2, wherein the phosphor layer is formed by the precipitation method.

6. A method of producing a cathode ray tube as set fourth in claim 1, wherein the difference in temperature between the temperature of the glass bulb and the temperature of the liquid is not less than 0° C. and not more than 15° C.

7. A method of producing a cathode ray tube as set forth in claim 1, wherein the phosphor layer is formed by the precipitation method.

8. A method of producing a cathode ray tube as set forth in claim 6, wherein the phosphor layer is formed by the precipitation method.

* * * * *